United States Patent [19]

Block

[11] Patent Number: 4,683,683

[45] Date of Patent: Aug. 4, 1987

[54] ABRASIVE MATERIAL MOUNTING STRUCTURE

[76] Inventor: Aleck Block, 800 Warner Ave., Los Angeles, Calif. 90024

[21] Appl. No.: 767,352

[22] Filed: Aug. 19, 1985

[51] Int. Cl.[4] ..... B24D 13/14; B24D 13/20

[52] U.S. Cl. ..... 51/377; 51/378; 51/389

[58] Field of Search ..... 51/358, 376, 377, 378, 51/379, 388, 389; 15/49 R, 50 R

[56] References Cited

U.S. PATENT DOCUMENTS

| | | | |
|---|---|---|---|
| 1,724,742 | 8/1929 | Albertson et al. | 51/378 |
| 3,157,010 | 11/1964 | Block | 51/377 |
| 3,266,200 | 8/1966 | Block | 51/377 |
| 3,574,978 | 4/1971 | Block | 51/377 |
| 4,245,438 | 1/1981 | van Buren, Jr. | 51/377 |

*Primary Examiner*—Robert P. Olszewski

*Attorney, Agent, or Firm*—Ellsworth R. Roston; Charles H. Schwartz

[57] ABSTRACT

A disc may have a backing member or sheet and an abrasive sheet, each with first and second opposed faces. The first face of the abrasive sheet may be attached to the second face of the backing sheet and the second face of the abrasive sheet may be provided with abrasive particles. Alternatively, the sheets may be integrated into a single member. A staple is attached to the sheets and is provided with body and end portions. The body portion of the staple extends along the first surface of the abrasive sheet and the end portions of the staple extend through the sheets. The end portions are turned inwardly against the second surface of the backing sheet. In one embodiment, the sheets have a central opening and the end portions of the staple abut the second surface of the backing sheet. A holder detains the body portion of the staple. In another embodiment, the end portions of the staple define a looped relationship with the second surface of the backing sheet and the holder cooperates with such looped relationships to detain the disc. The detention by the holder may be provided at the periphery of the holder or at positions within the holder. The holder and the disc may be associated with a camming member and with a reinforcing plate. The camming member and the reinforcing plate cooperate with each other and with the holder to insure that the holder and the disc can be easily removed from the camming member and the reinforcing plate even when the holder has become jammed against the reinforcing plate by the application of a force by a workpiece against the disc.

49 Claims, 20 Drawing Figures

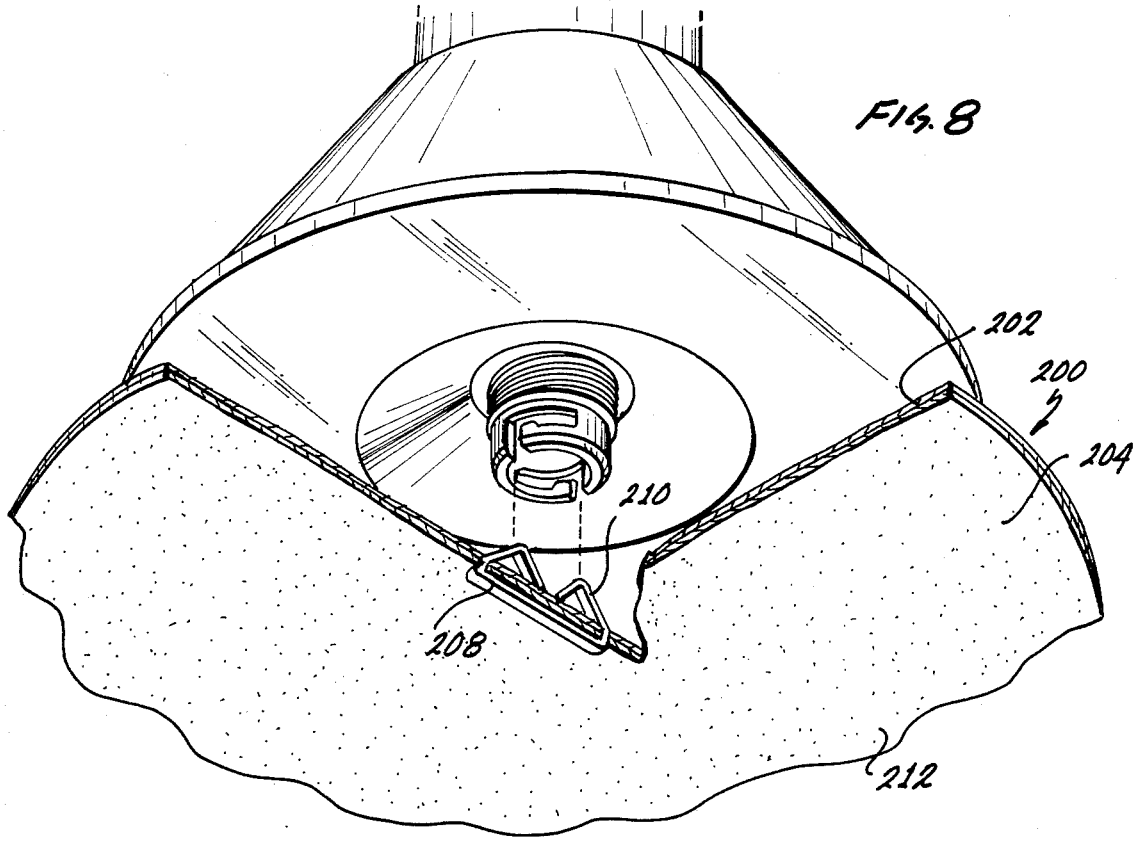
FIG. 8
FIG. 9
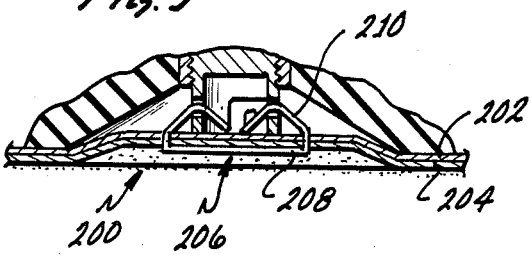
FIG. 11
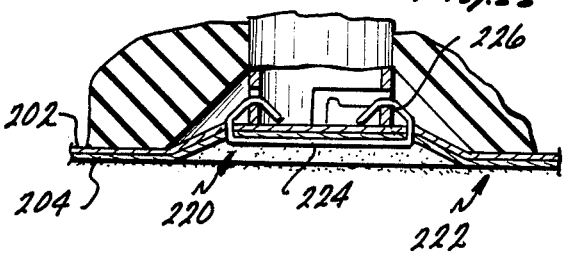
FIG. 10
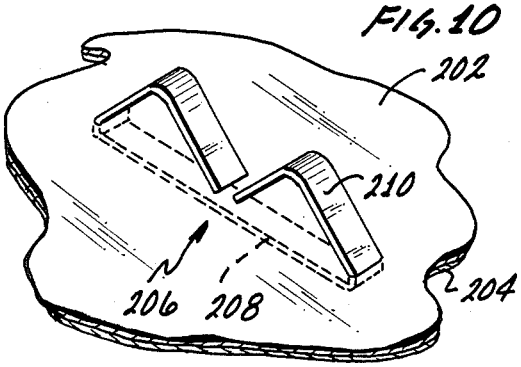
FIG. 12
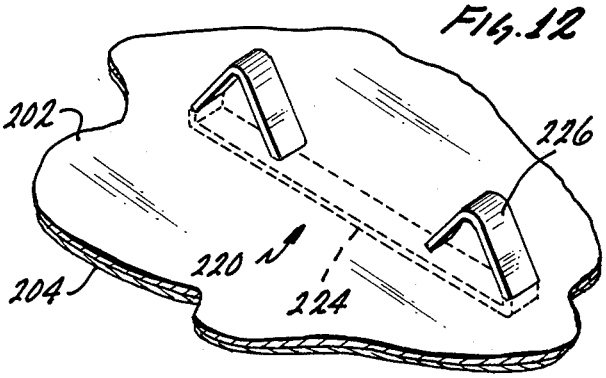

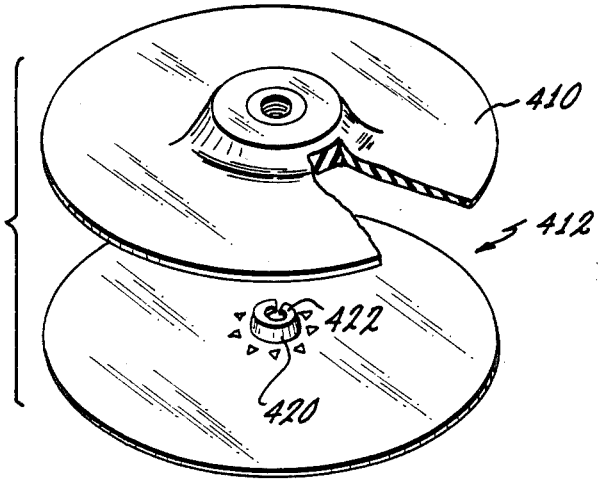
FIG. 18
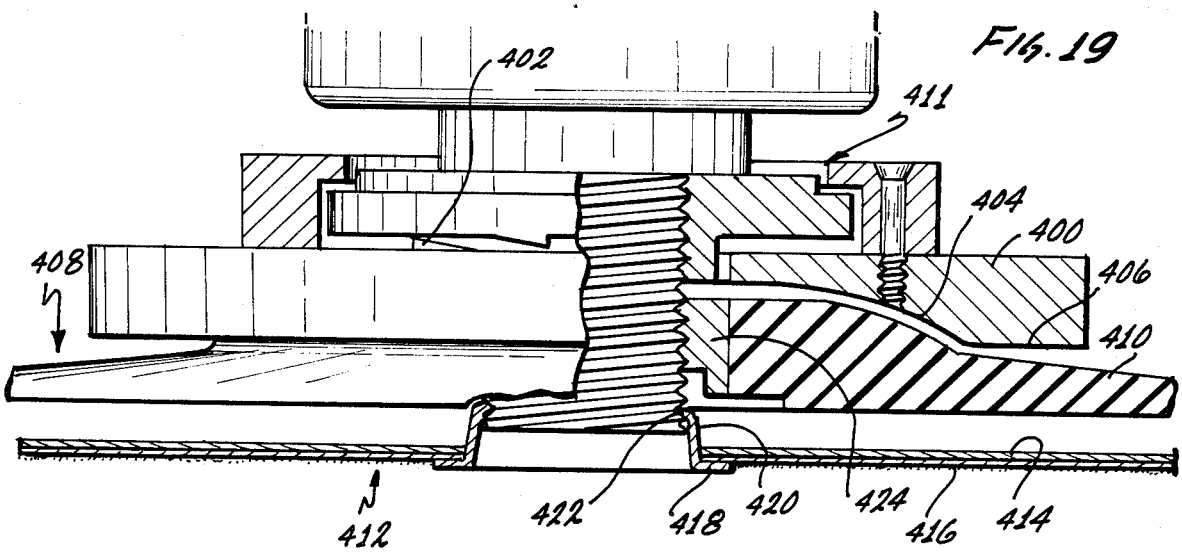
FIG. 19
FIG. 20
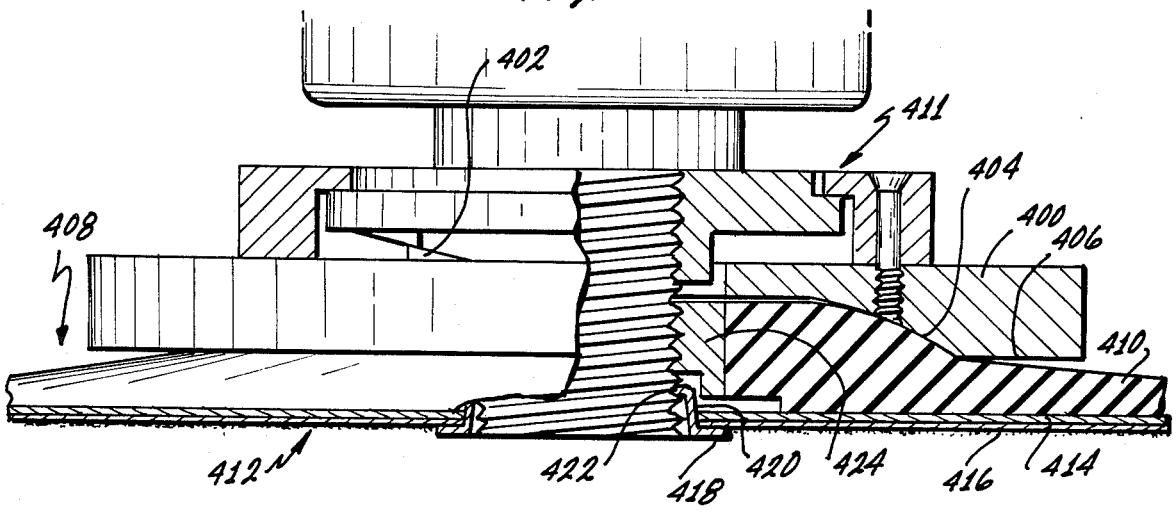

ABRASIVE MATERIAL MOUNTING STRUCTURE

This invention relates to abrasive apparatus. More particularly, it relates to an abrasive disc which can be made simply and which operates reliably to provide an abrasive action. The invention also relates to a holder for such a disc and to a combination of the disc and the holder.

Abrasive discs are widely used to polish surfaces of a workpiece or to provide proper dimensions on such surfaces of the workpiece. The abrasive discs generally are formed from a backing member or sheet and from an abrasive sheet having abrasive particles on one surface of the sheet. A member is generally attached to the disc to provide for a coupling of the disc to a holder which drives the disc. In this way, the disc and the holder are provided with a resilient relationship so that the disc can be applied against normally inaccessible positions on the workpiece.

Abrasive discs as described in the previous paragraph have only a limited life when applied against a workpiece. The discs are disposable so that they can be replaced after they have been used. Since the discs are disposable and have only a limited life, they are used in great quantity. It is accordingly important that the discs should be simply and reliably constructed and inexpensive.

A wide variety of abrasive discs are now in use. Although these discs have a considerable utility, they are relatively complex in construction and not always reliable in operation. For example, the coupling members on the disc occasionally become separated from the backing member and the abrasive sheet when the disc is applied to a workpiece, so that the sheets are free to fly like unguided missiles across an enclosure such as a room. Since these sheets travel at high speeds, they can injure individuals in the enclosure, particularly the person who is applying the discs against the workpiece.

A considerable effort has been made, and considerable moneys have been expended, for a long period of time to provide a disc which is simply and inexpensively constructed and which is reliable. Although some progress has been made, the discs now in use are relatively complex and expensive and are not always reliable. They still are relatively difficult to couple to a holder and to decouple from the holder. The coupling members on the discs also tend sometimes to become uncoupled from the discs when the discs are applied against a workpiece.

This invention provides a disc which overcomes the disadvantages discussed above. The disc is quite simple and inexpensive. It also operates reliably when coupled to a coupling member and when applied thereafter against a workpiece. The invention also provides a coupling member which operates in conjunction with the disc to provide an easy, simple and reliable engagement between the disc to the coupling member and an easy, simple and reliable disengagement of the disc from the coupling member.

In one embodiment of the invention, disc may have a backing member or sheet and an abrasive sheet, each with first and second opposed faces. The first face of the abrasive sheet may be attached to the second face of the backing sheet and the second face of the abrasive sheet may be provided with abrasive particles. A staple is attached to the sheets and is provided with body and end portions. The body portion of the staple extends along the first surface of the abrasive sheet and the end portions of the staple extend through the sheets. The end portions are turned inwardly against the second surface of the backing sheet.

In one embodiment, the sheets have a central opening and the end portions of the staple abut the second surface of the backing sheet. A holder detains the body portion of the staple. In another embodiment, the end portions of the staple define a looped relationship with the second surface of the backing sheet and the holder cooperates with such looped relationships to detain the disc. The detention by the holder may be provided at the periphery of the holder or at positions within the holder.

The holder and the disc may be associated with a camming member and with a reinforcing plate. The camming member and the reinforcing plate cooperate with each other and with the holder to insure that the holder and the disc can be easily removed from the camming member and the reinforcing plate even when the holder has become jammed against the reinforcing plate by the application of a force by a workpiece against the disc.

In the drawings:

FIG. 8 is an enlarged fragmentary perspective view of the holder shown in FIGS. 1 through 4 and of a second embodiment of a disc, with the disc being partially broken away to show the holder in some detail;

FIG. 9 is an enlarged fragmentary sectional view of the holder and the disc of FIG. 8 in a coupled relationship;

FIG. 10 is an enlarged fragmentary perspective view of the disc shown in FIGS. 8 and 9;

FIG. 11 is an enlarged fragmentary sectional view similar to that shown in FIG. 9 but shows the holder and a modified disc in a coupled relationship;

FIG. 12 is an enlarged fragmentary perspective view of the modified disc shown in FIG. 11;

Figure 1:
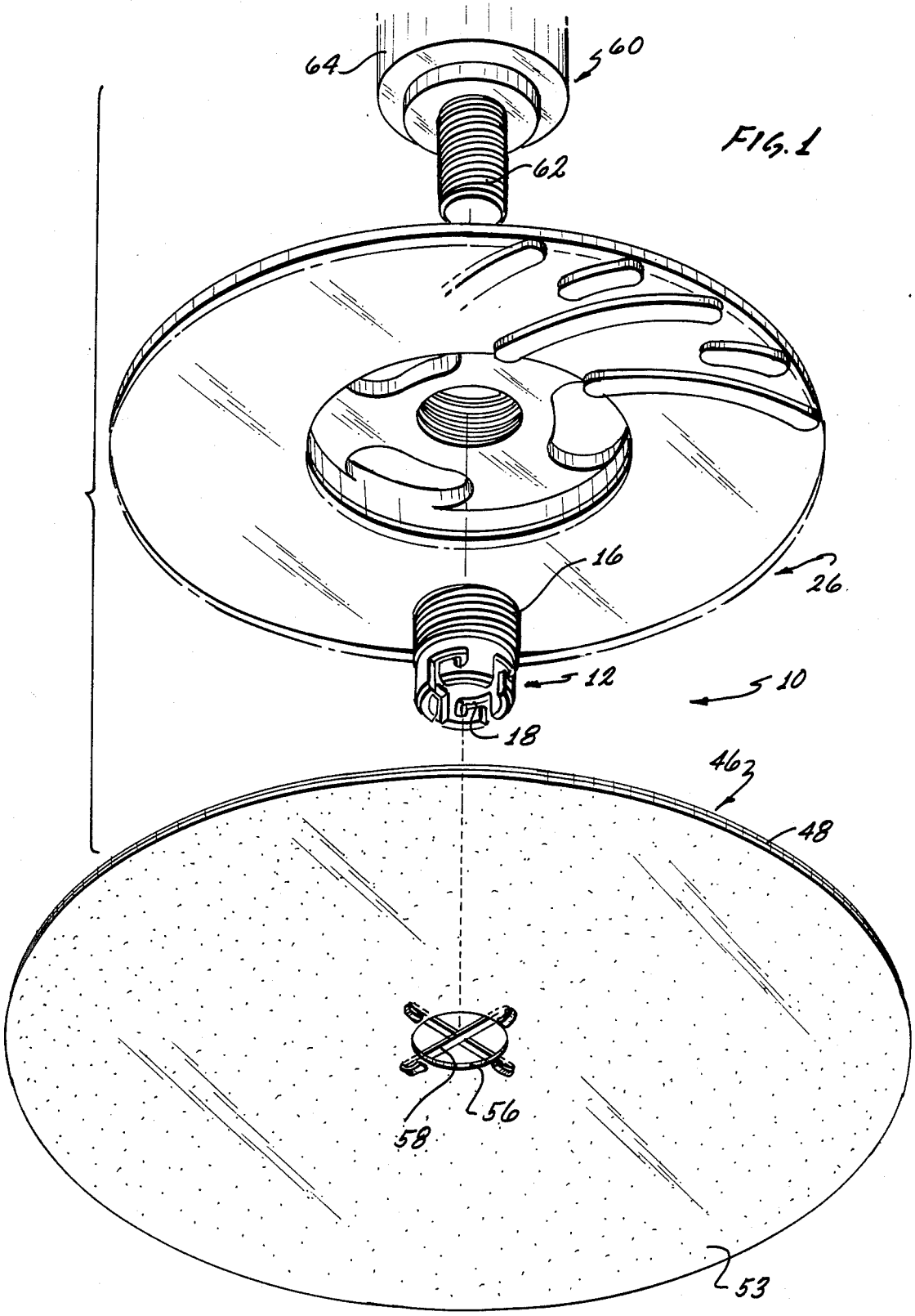
FIG. 1 is an enlarged exploded perspective view of a holder and a disc constituting one embodiment of the invention.
Figure 2:
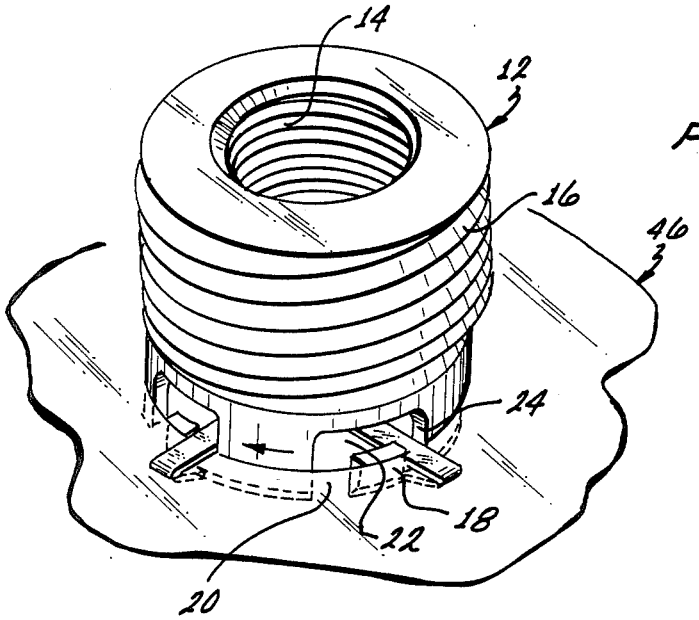
FIG. 2 is an enlarged perspective view of a coupling member included in the holder shown in FIG. 1.
Figure 3:
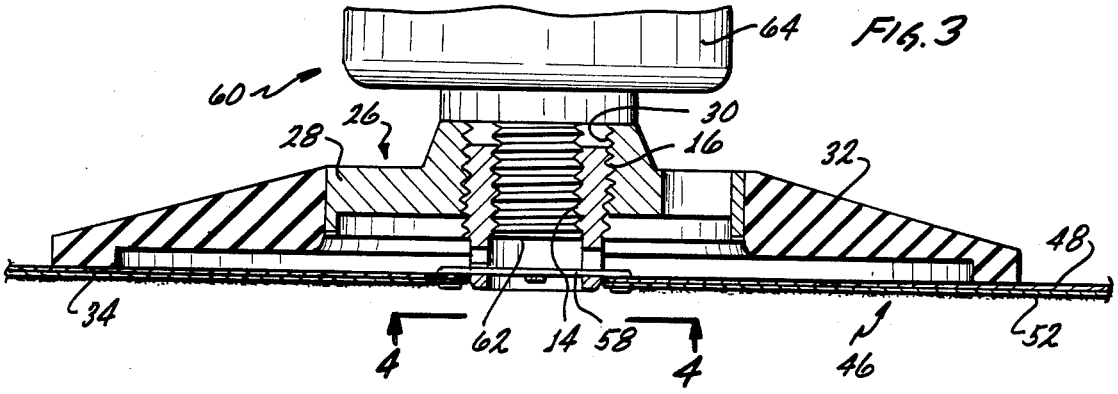
FIG. 3 is a fragmentary sectional view of the holder and the disc in an assembled relationship on an arbor.
Figure 4:
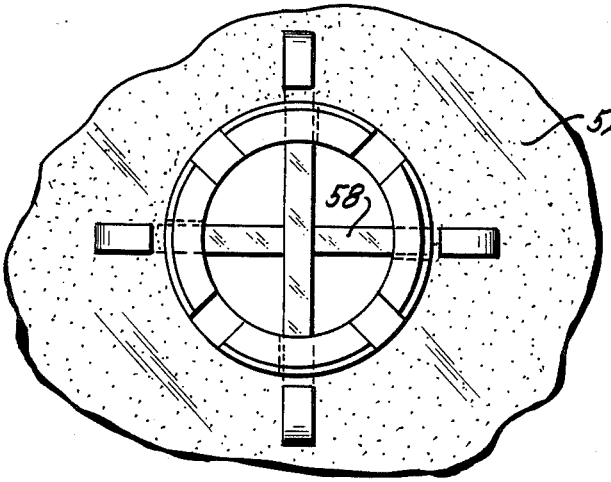
FIG. 4 is a sectional view taken substantially on the line 4—4 of FIG. 1.

FIG. 18 is an exploded perspective view of a holder and a disc for use in another embodiment of the invention, FIG. 19 is a fragmentary sectional view of the embodiment shown in FIG. 18 when the embodiment is used in combination with a camming member and a reinforcing plate included in previous embodiments of the invention, the members being shown before any frictional engagement between the holder and the disc; and FIG. 20 is a fragmentary sectional view similar to that shown in FIG. 19 but illustrates the relative disposition of the members after a frictional relationship has been established between the holder and the disc.

In one embodiment of the invention, an abrasive article generally indicated at 10 includes a hollow coupling member generally indicated at 12. The hollow coupling member 12 is internally threaded as at 14 and is externally threaded as at 16. The coupling member 12 has detents 18, each of which is defined by a vertical opening 20, a horizontal opening 22 communicating with the vertical opening 20 and a vertical cut 24 extending downwardly from the horizontal opening 22.

A support member generally indicated at 26 is associated with the coupling member 12. The support member 26 includes a collar 28 made from a suitable material such as steel and internally threaded as at 30 to become screwed on the external threads 16 of the coupling member 12. A rubber support pad 32 is attached to the external periphery of the support member 26. The support pad is preferably made from a suitable resilient material such as rubber. Preferably the rubber is open cell neoprene since open cell neoprene will not rupture when it is compressed. The support pad 32 is preferably tapered with progressive distances toward its periphery. The pad 32 is provided with a flat surface 34. The collar 28 is preferably indented relative to the flat surface 34 of the support pad 30.

A disc generally indicated at 46 is operatively associated with the holder 12. The disc 46 includes a backing member 48 made from a stiff but resilient material such as fiberboard. The backing member 48 is provided with first and second spaced but parallel surfaces 50 and 51. An abrasive sheet 50 may be attached to the surface 50 of the backing member 48 and abrasive particles 54 are adhered to the surface of this abrasive sheet. Although the backing member 48 and the abrasive sheet are illustrated in the embodiment shown in FIGS. 1 through 4, it will be appreciated that the backing member and the abrasive sheet may be combined into a single element with abrasive particles on one surface of the element.

The backing member 48 is provided with a central aperture 56 and the abrasive sheet 52 is provided with a similar aperture 57. At least one staple 58 is attached to the backing member 48 at opposite ends such that the body portion of the staple extends diagonally across the openings 56 and 57. Preferably the body portion of the staple 58 is disposed adjacent the surface 51 of the backing member 48. Preferably a pair of staples 58 are provided in a perpendicular relationship. The body portions of the staples 58 are engaged by the detents 18 on the holder when the disc 46 is coupled to the holder.

An arbor generally indicated at 60 has a shank portion 62 which is externally threaded. The shank portion 62 is rotatable by a motor 64. The shank portion 62 is screwed into the internally threaded portion 14 of the holder 12 when the abrasive article 10 is to be operated to polish a workpiece (not shown).

The coupling member 12 is screwed in the support member 26 and the arbor 62 is screwed in the coupling member 12. This causes the coupling member 12, the support member 26 and the arbor 62 to have the relationship shown in FIG. 3. The disc 46 is then inserted on the coupling member 12 so that the staples 58 engage the detents 18. In this relationship, the backing member 48 on the disc 46 is supported by the support pad 32. The disc is then ready to be applied against a workpiece (not shown) when the arbor 62 is rotated. The disc 46 cannot become disengaged from the coupling member 12 during the application of the disc against the workpiece because the disc is firmly engaged on the coupling member 12 by the engagement between the staple 58 and the detents 18 on the coupling member.

The apparatus described above has certain important advantages. It provides a disc 46 which is relatively easy to manufacture and assemble, particularly in view of the construction of the staples 58 and the attachment of the staples to the backing member 48 and the abrasive sheet 52. The disc 46 is also advantageous in that it can be easily coupled to the member 26 and easily decoupled from the member 26. Furthermore, the disc 46 can be easily decoupled from the member 26 even when considerable forces have been applied by the disc against a workpiece. The easy decoupling of the disc 46 from the workpiece is in contrast to the discs and holders of the prior art since the discs tend to become jammed against the holders in the prior art, particularly when large forces are applied by the disc against the workpiece.

Figure 5:
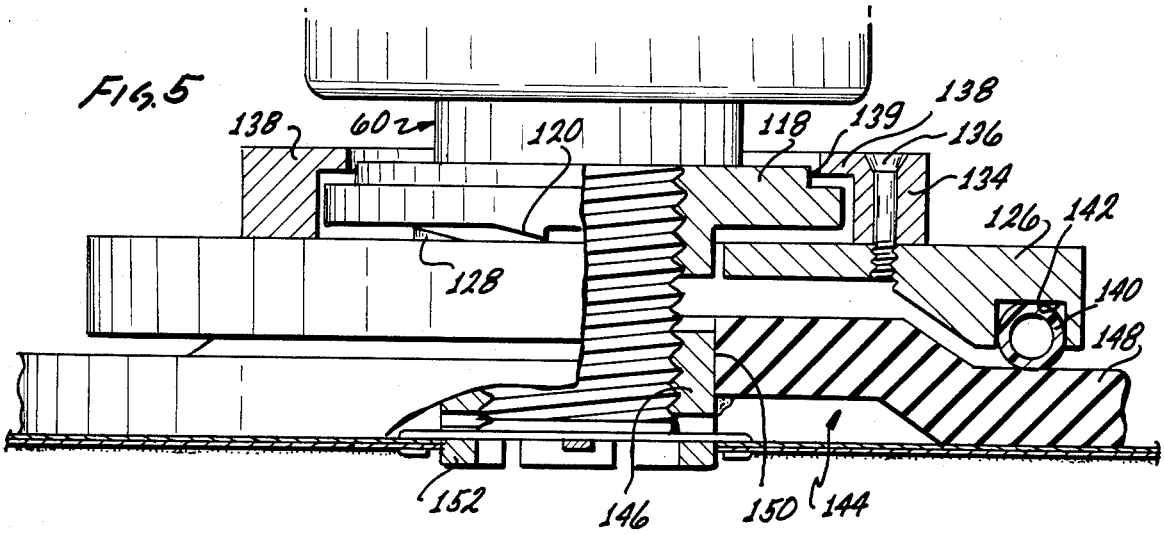
FIG. 5 is a sectional view of another embodiment of the invention and further illustrates a camming member and a reinforcing member which are associated with the holder and are operative with the elements shown in FIGS. 1 through 4 to insure a positive coupling between the holder and the disc.
Figure 6:
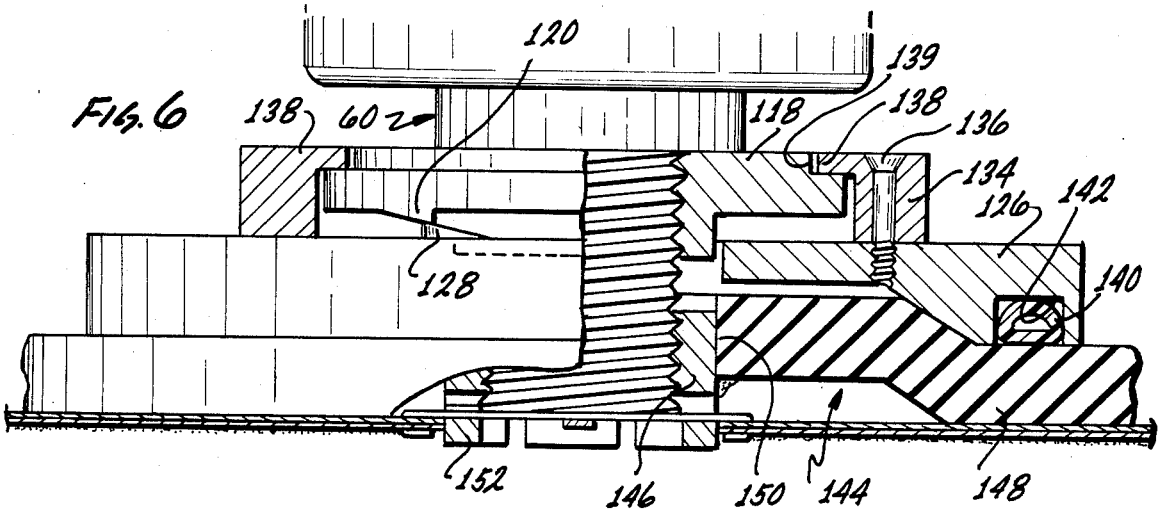
FIG. 6 is a sectional view similar to that shown in FIG. 5 but illustrates the positive coupling produced between the holder and the disc when the arbor is rotated and the disc is applied against a workpiece.
Figure 7:
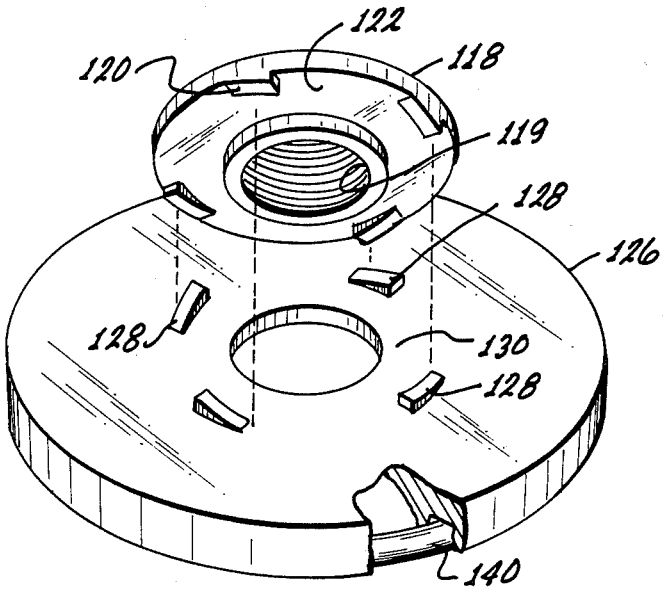
FIG. 7 is an exploded perspective view of the camming member and the reinforcing plate shown in FIGS. 5 and 6.

In the embodiment shown in FIGS. 5, 6 and 7, a camming member 118 has an internally threaded bore 119. The camming member 118 is provided with a plurality of inclined surfaces 120. The inclined surfaces 120 are preferably separated by flat surfaces 122. When four inclined surfaces 120 are provided on the camming member 118, each of the flat surfaces 122 may have an angular length such as approximately seventy-five degrees (75°) and the inclined surfaces may have an angular length such as approximately fifteen degrees (15°). The inclined surfaces 120 form a relatively shallow angle with the flat surfaces 122. This angle may be between approximately three degrees (3°) and nine degrees (9°) and is preferably about six degrees (6°). The inclined surfaces 120 and the flat surfaces 122 are preferably smooth and uniform.

A reinforcing plate 126 is disposed in abutting relationship with the camming member 118. The reinforcing plate 126 is provided on one face with inclined surfaces 128 and flat surfaces 130 corresponding substantially to the inclined surfaces 120 and the flat surfaces 122 on the camming member 118. The inclined surfaces 128 and the flat surfaces 130 are preferably smooth and uniform.

A detent member 134 may be suitably attached to the reinforcing plate 126 as by bolts 136. The detent member 134 includes a flange 138 which overhangs a shoulder 139 on the camming member 18. A yieldable clutching member 140 may be disposed in a pocket 142 on the opposite surface of the reinforcing plate 126 from the inclined surfaces 128.

The construction of a camming member corresponding to the camming member 118 and a reinforcing plate corresponding to the reinforcing plate 126 is fully disclosed and claimed in application Ser. No. 692,235 now U.S. Pat. No. 4,655,006 and alternate arrangements for performing the same functions as the camming member 118 and the reinforcing plate 126 are fully disclosed and claimed by me in co-pending application Ser. No. 692,234 now U.S. Pat. No. 4,637,170.

A holder 144 generally indicated at 144 is associated with the camming member 118 and the reinforcing plate 126. The holder 144 may include a coupling member 146 and a support pad 148 having an aperture 150 for receiving the coupling member 146. The coupling member 146 has detents 152 corresponding to the detents 18 in the embodiment shown in FIGS. 1 through 4. The coupling member 146 may be suitably supported in the aperture 150 of the support pad 148 for slidable movement axially in the aperture.

The apparatus shown in FIGS. 5 through 7 is ready to be applied to a workpiece (not shown) when the coupling member 150 and the adhesive disc 46 have the relative positions shown in FIG. 5. The force then exerted by the workpiece against the disc 46 during the rotation of the disc and during the application of the disc against the workpiece causes the disc 46, the support member 150 and the reinforcing plate 126 to rotate relative to the camming member 116 until the inclined surfaces 128 on the reinforcing plate 126 reach the inclined surface 120 on the camming member 118.

Continued rotation of the disc 46 and the reinforcing plate 126 relative to the camming member 118 causes the inclined surfaces 128 on the reinforcing plate 126 to ascend the inclined surfaces 120 on the camming member 118. This produces a movement of the reinforcing plate 126 axially (downwardly in FIG. 5) toward the support pad 148 such that the reinforcing plate 126 and the support pad 148 become closely coupled as shown in FIG. 6. This results from the compression of the clutching member 140 as shown in FIG. 6. As a result of this close coupling between the reinforcing plate 126 and the support pad 148, the disc 46 is tightly coupled to the arbor 60 for rotation with the arbor.

When the disc 46 becomes worn, it may be desired to replace the worn disc with an unused unit. To do so, a force is applied to the worn disc 46 on the arbor 60 to move the disc away from the reinforcing plate 126. This movement to disassociate the disc 46 from the arbor 60 is facilitated by the counter movements of the camming member 118 and the reinforcing plate 126 in directions such that the inclined surface 128 on the reinforcing plate 126 descend the inclined surfaces 120 on the camming member 118. This causes the reinforcing plate 126 and the camming member 118 to become decoupled. This causes the clutching member 140 to assume the position shown in FIG. 5 so that the backing member 48 is relatively loose in relationship to the disc 46. As a result, it is considerably easier to uncouple the disc 46 from the arbor 60 than in the discs and arbors of the prior art.

It will be appreciated that the yieldable clutching member 140 can be disposed on the support pad 148 instead of on the reinforcing plate 126. Furthermore, when the yieldable clutching member 140 is provided on the reinforcing plate 126, a projection (not shown) can be provided on the support pad 148 to engage the clutching member and facilitate the compression of the clutching member 140 from the relationship shown in FIG. 5 to the relationship shown in FIG. 6. The yieldable clutching member 140 can also be replaced as by a spring 60, such as a helical spring, which can be provided with more than one turn and which can be disposed in the pocket 142. An undulating spring can also be used. The different relationships described in this paragraph are fully disclosed and claimed in application Ser. No. 692,235, now U.S. Pat. No. 4,655,006 and assigned of record to the assignee of record in this application.

In the embodiment shown in FIGS. 1 through 4 and the embodiment shown in FIGS. 5 through 7 and discussed above, the coupling member (12 in FIGS. 1 through 4 and 146 in FIGS. 7 through 9) engages the body portions of the staples 58 at positions adjacent the apertures 56 in the backing sheet 48. In the embodiment shown in FIGS. 8, 9 and 10, a disc generally indicated at 200 is provided with a backing member 202 and an abrasive sheet 204 without any apertures. As in the previous embodiments, the backing member 202 and the abrasive sheet 204 may be combined into a single member without departing from the scope of the invention.

The disc 200 also includes a staple or staples generally indicated at 206, each having a body portion 208 and end portions 210. The body portion 208 of each staple 206 is disposed in substantially abutting relationship with an abrasive surface 212 on the abrasive sheet 204. The end portions 210 of the staples are disposed in a looped relationship defined by extremities adjacent the back surface of the backing member 202 and the portions of the staple piercing the backing member. The looped relationship may define triangles in section.

The detents 152 in the coupling member 146 are extended through the end portions 210 of the staples as shown in FIG. 9 and the disc 200 is then twisted in a direction to provide an engagement between the detents and the disc. This engagement is maintained while the arbor 60 is rotated and the abrasive surface of the disc 200 is applied against a workpiece. As will be seen, the central portion of the disc 200 is depressed when the looped relationships 210 on the staples 206 engage the detents 152. This recesses the staples from the plane of the abrasive surface 212 which is applied against the workpiece. To disengage the disc 200 from the coupling member 12, the disc is rotated in the opposite direction.

When the camming member 118, the reinforcing plate 126, the support number 144 and the disc 200 are assembled and the disc is applied against a workpiece (not shown), the inclined surfaces 128 on the reinforcing plate 126 move on the inclined surfaces 120 on the camming member 118. This causes the clutching member 140 to become depressed as shown in FIG. 6. This in turn causes a firm coupling relationship to be established between the support pad 148 and the reinforcing plate 126.

The embodiment shown in FIGS. 8, 9 and 10 offers certain advantages over the prior art in addition to those discussed above with respect to the disc 46 shown in the embodiments of FIGS. 1 through 7. One additional advantage is that the staples 206 provide an even more positive engagement with the detents 152 in the coupling member 150 than the staples 58 in the embodiments shown in FIGS. 1 through 7. This results from the fact that the detent portions 152 of the coupling member 150 extend through the looped relationships defined by the end portions 210 of the staples 206. This tends to insure that the disc 200 will be retained in firm position on the coupling member 150 while the disc 200 is applied against a workpiece.

The embodiment shown in FIGS. 8, 9 and 10 has other important advantages. As will be seen, the central positions on the backing member 202 and the abrasive sheet 204 on the disc 200 are recessed. This removes the staples 206 from the plane defined by the peripheral portions of the backing member 202 and the abrasive sheet 204 on the disc 200. This prevents the staple 206 from engaging the workpiece as the disc 200 is applied against the workpiece. It further enhances the ability of the disc 200 to provide a uniform and controlled abrading or polishing action against the workpiece. It further enhances the ability of the disc 200 to provide an abrading or polishing action against the workpiece along the full area of the backing member 202 and the abrasive sheet 204 on the disc from the periphery of the backing member and the abrasive sheet to the diametrical portion adjacent the recess in the backing member and the abrasive sheet at the center of the backing member and the abrasive sheet.

The embodiment shown in FIGS. 8, 9 and 10 also has other advantages of some importance. For example, the backing member 202 and the abrasive sheet 204 in the disc 200 are continuous at their central portions rather than being provided with a central opening as in the backing member 48 and the abrasive sheet 52 in the embodiments shown in FIGS. 1 through 7. This enhances the strengths of the backing member 202 and the abrasive sheet and their ability to retain the staple 206, without tearing, even while large forces are being applied by the workpiece against the disc 200.

FIGS. 11 and 12 illustrate a modified form of the staple shown in FIGS. 8, 9 and 10. In the embodiment shown in FIGS. 11 and 12, a staple generally indicated at 220 is attached to the backing member of a disc generally indicated at 222. The staple 220 includes a body portion 224 and end portions 226 disposed in a looped configuration. However, each of the end portions 226 is tightly looped in the enbodiment shown in FIGS. 11 and 12 so that there is a considerable spacing between the end portions 226 along the length of the body portion 224. Since the end portions 206 are looped, the central portions of the backing members and the abrasive sheet can be continuous as in the embodiment shown in FIGS. 8, 9 and 10.

As will be seen, the staples 220 are engaged by the detents 150 of the coupling member 146 in a manner similar to the engagement between the staples 206 and the detents 150 of the coupling member 146 in the embodiment shown in FIGS. 8, 9 and 10. However, because of their relatively tight coupling, the end portions 226 of the staples 220 have a relatively tight fit with the detents 150 on the coupling member 146. This inhibits any tendency of the disc shown in FIGS. 11 and 12 to have any free movement relative to the coupling member 146 when the disc is applied against a workpiece.

Like the embodiment shown in FIGS. 8, 9 and 10, the embodiment shown in FIGS. 11 and 12 is advantageous because the center of the disc is recessed. This positions the staples 220 so that they do not interfere with the operation of the peripheral portion of the disc in abrading or polishing a workpiece. Furthermore, the recessed relationship of the central portion of the disc tend to increase the ability of the full area of the disc outside of the recessed portion to produce an abrading or polishing action on the workpiece without scratching or otherwise marring the workpiece.

Figure 13:
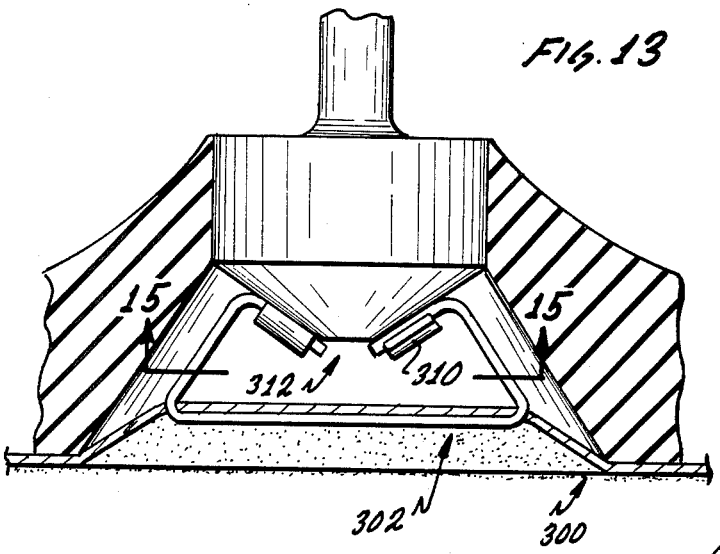
FIG. 13 is an enlarged fragmentary sectional view of another embodiment of a holder and a disc and shows the holder and the disc in a coupled relationship.
Figure 14:
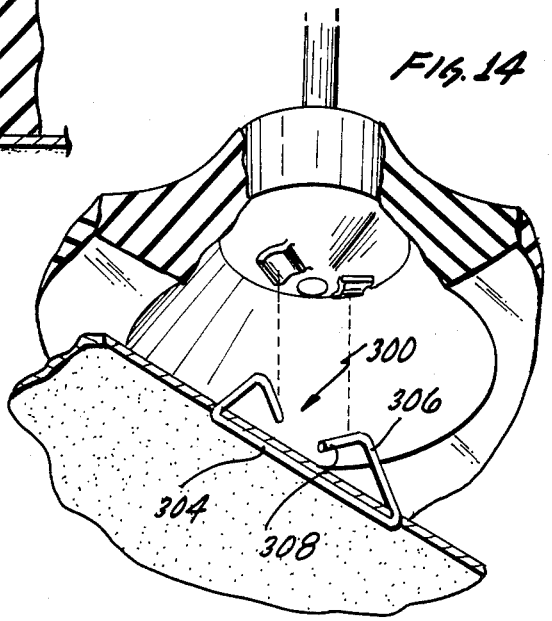
FIG. 14 is an enlarged fragmentary exploded perspective view of the holder and the disc shown in FIG. 13.
Figure 15:
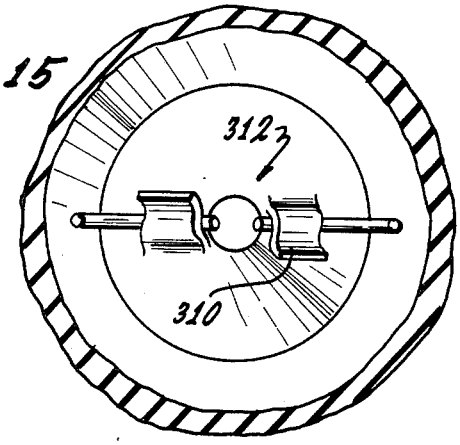
FIG. 15 is a sectional view of the holder and the disc of FIGS. 13 and 14 and is taken substantially on the line 15—15 of FIG. 13.

FIGS. 13, 14 and 15 illustrate another embodiment of the invention. In this embodiment, a disc generally indicated at 300 supports a staple generally indicated at 302. The staple 302 includes a body portion 304 and end portions 306. The end portions 306 are looped but the loops are not as complete as the loops in the staple shown in FIGS. 8, 9 and 10 and the staple shown in FIGS. 11 and 12. This may be seen from the fact that the ends 308 of the staples are considerably displaced from the body portion 304 of the staple and are at a relatively shallow angle to the body portion of the staple.

The end portions 306 of the staple 300 are adapted to be inserted into clips 310 in a support member generally indicated at 312. The clips 310 are open at one end to facilitate the insertion of the end portions 306 of the staples 300 into the clips. The clips may be made from a suitable material such as steel and are provided with springlike characteristics to grip the ends of the staple 300 in firm but removable relationship.

As will be seen, the embodiment shown in FIGS. 13, 14 and 15 has certain of the advantages included in the embodiment shown in FIGS. 8, 9 and 10 and the embodiment shown in FIGS. 11 and 12. For example, the central portions of the backing member and the abrasive sheet in the embodiment shown in FIGS. 13, 14 and 15 are recessed. Furthermore, the central portions of the backing member and the abrasive sheet are respectively integral with the peripheral portions of the member and the sheet in this embodiment since no holes are provided in the backing member or the abrasive sheet.

The embodiment shown in FIGS. 13, 14 and 15 has certain advantages in addition to those discussed above for the embodiment shown in FIGS. 8, 9 and 10 and the embodiment shown in FIGS. 11 and 12. For example, the coupling between the staple 300 and the clips 310 on the support member 312 and the disengagement of the staple 300 from the clips 310 are facilitated in the embodiment shown in FIGS. 13, 14 and 15 without sacrificing any strength in the coupled relationship.

Figure 16:
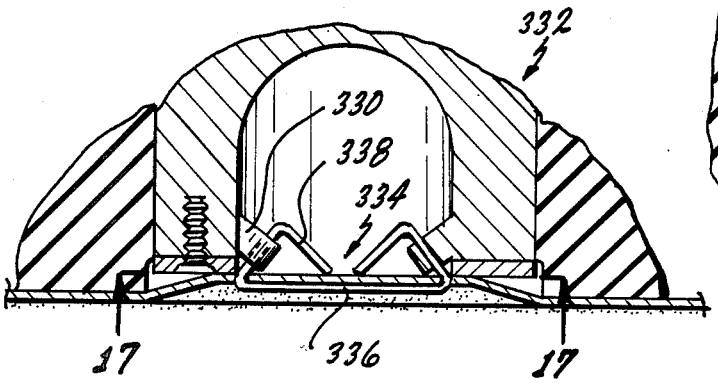
FIG. 16 is an enlarged fragmentary sectional view of another embodiment of a holder and the disc illustrates the holder and the disc in a coupled relationship.
Figure 17:
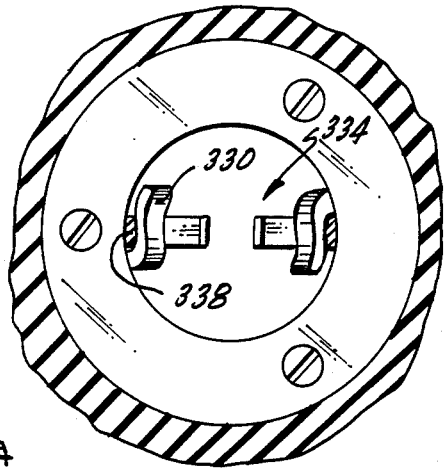
FIG. 17 is a sectional view of the holder and the disc of FIG. 16 and is taken substantially on the line 17—17 of FIG. 16.

The embodiment shown in FIGS. 16 and 17 is similar to the embodiments shown in FIGS. 13, 14 and 15 in that clips 330 are included on a coupling member generally indicated at 332 and are provided with springlike characteristics corresponding to those of the clips 310 in FIGS. 13, 14 and 15. The clips 330 are constructed to engage staples generally indicated at 334. The staples 334 have a body portion 336 and end portions 338 with looped configurations. The staple 334 has a construction and a configuration corresponding to the construction and configuration of the staples 206 of FIGS. 8, 9 and 10. The clips 330 engage the end portions 338 of the staples 334 in a manner similar to that shown in FIGS. 13, 14 and 15 except that the engagement occurs with a different leg of the end portions 338 than in the embodiment shown in FIGS. 13, 14 and 15.

Another embodiment of the invention is shown in FIGS. 18, 19 and 20. In this embodiment, a retaining plate 400 is provided with inclined surfaces 402 at one end and with a dish-shaped configuration 404 at the central portion of the opposite end. The retaining plate 400 has a relatively flat peripheral portion 406 at the same end as the dish-shaped portion 404. A holder generally indicated at 408 is provided with a support pad 410 having a tapered shape at its periphery. The holder 408 may be constructed in a conventional manner and the support pad 410 may be provided with a conventional shape.

When the inclined surface 402 on the reinforcing plate 400 moves along the inclined surfaces on the camming member generally indicated at 411, the reinforcing plate 400 is moved axially into a position such that the relatively flat peripheral portion 406 of the reinforcing plate 400 engages the support pad 410. This causes a disc generally indicated at 412 to be rotated with the reinforcing plate 400 and the holder 408 when the disc is applied against a workpiece.

The disc 412 may be constructed as shown in the previous Figures and as described above or may be constructed in a conventional manner in accordance with the prior art. For example, the disc 412 may include a backing member 414, an abrasive sheet 416 and a drive member 418. The drive member 418 may include a collar portion 420 and a portion 422 defining a thread for engaging a threaded shank portion 424 on the holder 408. The disc may be constructed in a manner similar to that discribed and claimed in patent.

The embodiment shown in FIGS. 18, 19 and 20 has certain important advantages. It provides for direct coupling between the support pad 410 and the relatively flat peripheral portion 406 on the reinforcing plate 400 without any use of members such as the clutching member 140 in the embodiment shown in FIGS. 5, 6 and 7. It further provides for a relatively easy coupling of the support pad 410 and the disc 412 to the reinforcing plate 400. This may be accomplished by manually grasping the support pad 410 and the backing member 414 in one hand and manually rotating them in a direction to engage the support pad 410 with the relatively flat peripheral portion 406 of the reinforcing plate 400. This coupling is enhanced when the disc 412 is thereafter applied against a workpiece (not shown).

The embodiment shown in FIGS. 18, 19 and 20 also has another important advantage. In the prior art, the disc 412 tends to become frictionally bound against the support pad 410 when the disc is applied against a workpiece. The disc is then grasped individually and is tugged in a direction to decouple the disc from the workpiece. This decoupling can be accomplished at times only by tugging with great force on the disc 412.

In contrast, in the embodiment shown in FIGS. 18, 19 and 20, the disc 412 can be decoupled relatively easily from the support pad 410 by manually grasping the support pad 410 and the disc 412 in one hand and rotating them in a direction to move the inclined surfaces 402 on the reinforcing plate 400 down the inclined surfaces on the camming member 411. This moves the support pad 410 in a direction away from the disc 412. The disc 412 can then be manually grasped in one hand without grasping the support pad 410 and can be manually rotated in a direction to remove the disc from the holder 408.

Although this invention has been disclosed and illustrated with reference to particular embodiments, the principles involved are susceptible for use in numerous other embodiments which will be apparent to persons skilled in the air. The invention is, therefore, to be limited only as indicated by the scope of the appended claims.

I claim:

1. An abrasive disc for retention by detaining means and for application against a workpiece, including, means including a backing member having first and second opposite faces, there being particles on the first face of the means including the backing member for application against the workpiece, at least one staple attached to the means including the backing member, the staple including a body portion and opposite ends extending from the body portion with the body portion extending along a particular one of the first and second faces of the means including the backing member and with the opposite ends extending through the other one of the first and second faces of the means including the backing backing member and being bent toward the other one of the first and second faces for detention of the staple on the means including the backing member and for coupling of the staple to the detaining means, the body portion and the opposite ends of the staple defining substantially a common plane.

2. An abrasive disc as set forth in claim 1, including, at least a second staple disposed in angularly spaced relationship to the first staple and attached to the means including the backing member in the same manner as the first staple, the second staple having a body portion and opposite ends defining a substantially common plane transverse to the substantially common plane defined by the body portion and the opposite ends of the first staple.

3. An abrasive disc as set forth in claim 1, including, the end portions of the staple having a looped configuration for retention by the detaining means.

4. An abrasive disc as set forth in claim 1, including, the means including the backing member being open at its center and the body portion of the staple extending across the opening at the center of the means including the backing member for retention by the detaining means.

5. An abrasive disc as set forth in claim 1 wherein the staple is disposed in substantially flush relationship with the particular one of the first and second faces of the means including the backing member and is bent at its opposite ends into contiguous relationship with the other one of the first and second faces of the means including the backing member.

6. An abrasive disc as set forth in claim 1 wherein at least some of the body portion of the staple is disposed in substantially flush relationship with the particular one of the first and second surfaces of the means including the backing member and wherein the staple is disposed at its opposite ends in a substantially looped configuration relative to the other one of the first and second faces of the means including the backing member.

7. An abrasive disc as set forth in claim 6 wherein the portions of the staple defining the looped configuration are spaced from the other one of the first and second faces of the means including the backing member and wherein the ends of the loops abut the other one of the first and second faces of the means including the backing member.

8. An abrasive disc as set forth in claim 6 wherein the loops are constructed and shaped to receive the detaining means for detention of the disc by the holder and wherein the ends of the loops on the staple are spaced from the means including the backing member.

9. An abrasive disc constructed for retention by detaining means and for application against a workpiece, including, backing means having first and second opposite faces and having abrasive particles on a first face of the backing means, and at least one staple having a body portion and end portions, at least some of the body portion of the staple being disposed in substantially flush relationship with a particular one of the first and second faces of the backing means and the end portions of the staple extending through the first and second faces of the backing means and being folded toward the other one of the first and second faces of the backing means for retention of the staple by the backing means, the body portion and the end portions of the staple defining substantially a common plane, the staple being disposed relative to the backing means for retention of the staple by the detaining means.

10. An abrasive disc as set forth in claim 9 wherein the end portions of the staple abut the second face of the backing means.

11. An abrasive disc as set forth in claim 9 wherein the end portions of the staple are disposed in a substantially looped relationship with the other one of the first and second faces of the backing means.

12. An abrasive sheet as set forth in claim 9 wherein the end portions are disposed in a looped relationship, and the end portions of the staple in the looped relationships are defined by the extensions of the body portion of the staple in the substantially common plane through the backing means and by positions in the end of the staple in the substantially common plane.

13. An abrasive sheet as set forth in claim 12 wherein the looped relationships defined by the end portions of the staple are spaced from the second face of the backing means.

14. In combination for use with a workpiece, an abrasive disc including:

backing means having first and second opposite faces, and at least one staple having a body portion and end portions disposed in a substantially common plane, the body portion of the staple being disposed in substantially flush relationship with the first face of the backing means and the end portions of the staple extending through the backing means and being bent at the second face to retain the staple on the backing means, detaining means, and means disposed on the detaining means and engaging the staple at a particular one of the body portion and the end portions for retaining the disc on the detaining means even when the disc is applied against the workpiece.

15. A combination as set forth in claim 14 wherein the detaining means is provided with an opening shaped to define detents in the detaining means for holding the staple at the particular one of the body portion and the end portions of the staple.

16. A combination as set forth in claim 14 wherein the body portion extends in substantially a linear direction and the end portions are extensions of the body portion in the substantially linear direction.

17. A combination as set forth in claim 16 wherein the end portions of the staple have a looped configuration relative to the second face of the backing means and the detaining means engage the end portions of the staple in the looped configuration of the end portions.

18. A combination as set forth in claim 17 wherein the looped configuration at the end portions of the staple is defined by a first portion extending away from the second face of the backing means and a second portion extending toward the second portion.

19. A combination as set forth in claim 18 wherein the detaining means has an opening for receiving the staple and has means extending from the opening and shaped to detain the staple at the particular one of the body portion and the end portions of the staple.

20. An abrasive disc constructed for retention by detaining means and for application against a workpiece, including, backing means having first and second opposed faces, there being particles on the first surface of the backing means for application against the workpiece, there being an opening in the center of the backing means, and at least one staple attached to the backing means at positions near the periphery of the opening and extending substantially linearly across the opening in the center of the the backing means for detention of the staple by the detaining means at the opening in the backing means, the portion of the staple in the opening in the center of the backing means being disposed in substantially the plane of the backing means.

21. An abrasive disc as set forth in claim 20, including, at least a second staple disposed in angularly spaced relationship to the first staple and attached to the backing means at positions near the periphery of the opening in the backing means, the second staple having substantially the same construction as the first staple, the portion of the second staple in the opening in the center of the backing means being disposed substantially in the plane of the backing means.

22. An abrasive disc as set forth in claim 20, including, the ends of the staple extending through the first and second surfaces of the backing means and being bent relative to the surfaces of the backing means.

23. An abrasive disc as set forth in claim 20 wherein the staple is disposed in substantially flush relationship with a particular one of the first and second faces of the backing means and is extended through the first and second faces of the backing means and is bent into a substantially flush relationship against the other one of the first and second faces of the backing means.

24. An abrasive disc as set forth in claim 22 wherein the staple has end portions which extend through the first and second faces of the backing means and which are bent relative to the first and second faces of the backing means to extend in substantially parallel relationship with the first and second faces of the backing means.

25. An abrasive disc as set forth in claim 24 wherein the end portions of the staple are contiguous to the first face of the backing means.

26. An abrasive disc constructed for use with detaining means and for application against a workpiece, including, a backing member having first and second opposed faces, an abrasive sheet having a first face adhered to the second face of the backing member and having abrasive particles adhered to its second face, there being substantially aligned openings in the center of the backing member and the abrasive sheet, and at least one staple extending substantially linearly across the openings in the backing member and the abrasive sheet and through the backing member and the abrasive sheet at positions near such openings for detention of the staple by the detaining means at the portion of the staple adjacent the openings in the backing means and the abrasive sheet, the portion of the staple extending along the abrasive sheet being disposed in contiguous relationship to a particular one of the first and second faces of the abrasive sheet and the portion of the staple adjacent the opening in the abrasive sheet having a substantially common planar relationship with a particular one of the abrasive sheet and the backing member.

27. An abrasive disc as set forth in claim 26 wherein the staple is folded at its ends toward the other one of the first and second faces of the backing member.

28. An abrasive disc as set forth in claim 27 wherein the ends of the staple are substantially flush with the other one of the first and second faces of the backing member.

29. An abrasive sheet as set forth in claim 27 wherein a second staple having a construction corresponding to that of the first staple is attached to the backing member and the abrasive sheet in a manner corresponding to the attachment of the first staple to the backing member and the abrasive sheet and the second staple if disposed in transverse relationship to the first staple.

30. An abrasive sheet as set forth in claim 29 wherein the second staple is perpendicular to the first staple and abuts the first staple at the position of crossover between the first and second staples.

31. In combination for use with a workpiece, an abrasive disc including:

backing means having first and second opposed faces and having abrasive particles adhered to the second face of the backing means, there being an opening in the center of the backing means, at least one staple extending substantially linearly across the opening in the backing means and through the backing means at positions near such opening and bent at a position near a particular one of the first and second faces of the backing means to retain the staple on the backing means, the staple defining a substantially common plane along the length of the staple; and holding means, and means disposed on the holding means for engaging the staple at the openings in the backing means to rotate the disc with the holding means and to retain the disc on the holding means even when the disc is applied against the workpiece.

32. A combination as set forth in claim 31 wherein the holding means is provided with openings shaped to define detents for holding the staple at positions adjacent the opening in the backing means.

33. A combination as set forth in claim 32 wherein the staple extends across the opening in the backing means and along the particular one of the first and second faces of the backing means in a plane defining substantially an extension of the plane in the backing means and is folded near its ends to extend through the first and second faces of the backing means and is further folded against the other one of the first and second faces of the backing means after extending through the backing means.

34. A combination as set forth in claim 33 wherein the ends of the staple abut the other one of the first and second faces of the backing means.

35. A combination as set forth in claim 33 wherein a second staple having a construction corresponding to that of the first staple is attached to the backing means in a manner corresponding to the attachment of the first staple to the backing means and is disposed in a transverse relationship to the first staple for engaging the engaging means on the holding means.

36. A combination as set forth in claim 3 wherein a second staple having a construction corresponding to that of the first staple is attached to the backing means in a manner correponding to the attachment of the first staple to the backing means and is disposed in a transverse relationship to the first staple for engaging the engaging means on the holding means and abuts the first staple at the position of crossover with the first staple.

37. A combination as set forth in claim 33 wherein the holding means is substantially hollow and has a peripheral wall with openings defining detent means for retaining the staple at positions adjacent the openings in the backing means.

38. In combination for application against a workpiece, holding means; and means including a backing member having first and second opposed faces, there being particles on the first face of the means including the backing member for application against the workpiece, at least one staple attached to the means including the backing member, the staple including a body portion and opposite ends extending from the body portion and having at least some of the body portion disposed adjacent a particular one of the first and second faces of the means including the backing member and having at least its end portions extending through the means including the backing member and bent toward the other one of the first and second faces and disposed adjacent the other one of the first and second faces of the means including the backing member in at least an extremity position of such end portions, the body portion and the opposite ends of the staple having substantially a common plane; and means on the holding means for cooperating with the staple to detain the means including the backing member in fixed relationship to the holding means.

39. A combination as set forth in claim 38 wherein the means including the backing member has a central opening and the body portion of the staple extends across the central opening in substantially a common planar relationship with the means including the backing member and the detaining means on the holding means cooperates with the staple at positions adjacent the central bore to detain the means including the backing means in fixed relationship to the holding means.

40. A combination as set forth in claim 38 wherein the end portions of the staple define a looped relationship with the means including the backing member and wherein the detaining means on the holding means engage the end portions of the staple to obtain the fixed relationship between the holding means and the means including the backing member.

41. A combination as set forth in claim 38 wherein the body portion of the staple is disposed in a substantially flush relationship with the first face of the means including the backing member.

42. A combination as set forth in claim 39 wherein the ends of the staple are disposed in abutting relationship with the other one of the first and second faces of the means including the backing member in at least the extremity positions of such ends.

43. A combination as set forth in claim 40 wherein the detaining means are formed by clips in the holding means and the body portion of the staple is disposed in a substantially flush relationship with the particular one of the first and second faces of the means including the backing member.

44. In combination for application against a workpiece, holding means, a backing member having first and second opposed faces, an abrasive sheet having a first face adhered to the second face of the backing member and having abrasive particles adhered to its second face, at least one staple having a body portion and end portions, the body portion of the staple being disposed in substantially flush relationship with a particular one of the first and second faces of the abrasive sheet and the end portions extending through the abrasive sheet and the backing member, the end portions of the staple being bent near their extremities toward the abrasive sheet and the backing member to be retained by the backing member and the abrasive sheet, the body portion and the end portions of the staple being disposed in substantially a common plane; and means on the holding means for detaining the staple to provide a movement of the backing member and the abrasive sheet with the holding means and to provide for an application of the second face of the abrasive sheet against the workpiece.

45. A combination as set forth in claim 44 wherein an opening is provided in the central portions of the backing member and the abrasive sheet and the body portion of the staple is disposed adjacent the opening in the central portions of the backing member and the abrasive sheet in a substantially common planar relationship with the abrasive sheet and the detaining means on the holding means engages the body portion of the staple in the region of the opening in the backing member and the abrasive sheet.

46. A combination as set forth in claim 44 wherein the end portions of the staple are displaced from the first face of the backing member and the detaining means are disposed in retaining relationship with the end portions of the staple.

47. A combination as set forth in claim 46 wherein the end portions of the staple have looped configurations and the holding means has clips with spring-like characteristics, the clips being open at one end, and wherein the clips engage the end portions of the staple.

48. A combination as set forth in claim 46 wherein the holding means includes a coupling member having openings to define detents and wherein the detents engage the end portions of the staple at positions displaced from the body portion of the staple.

49. A combination as set forth in claim 46 wherein the end portions of the staple define looped configurations and wherein the detaining means on the holding means extend through the looped configurations at the end portions of the staple to hold the abrasive member and the backing sheet in fixed relationship with the holder and wherein the detaining means are disposed to recess the central portion of the backing member and the abrasive sheet relative to the peripheral portions of the backing member and the abrasive sheet when the detaining means extends through the looped configurations at the end portions of the staple.

* * * * *